US006554926B2

(12) United States Patent
Stratton

(10) Patent No.: US 6,554,926 B2
(45) Date of Patent: Apr. 29, 2003

(54) QUENCHING HEATED METALLIC OBJECTS

(75) Inventor: Paul Francis Stratton, West Yorkshire (GB)

(73) Assignee: The BOC Group, plc, Windlesham (GB)

( * ) Notice: Subject to any disclaimer, the term of this patent is extended or adjusted under 35 U.S.C. 154(b) by 0 days.

(21) Appl. No.: 09/735,818

(22) Filed: Dec. 13, 2000

(65) Prior Publication Data

US 2001/0020503 A1 Sep. 13, 2001

(30) Foreign Application Priority Data

Dec. 17, 1999 (GB) ..... 9929956

(51) Int. Cl.[7] ..... C21D 1/613; C21D 1/667
(52) U.S. Cl. ..... 148/712; 660/661; 660/662
(58) Field of Search ..... 148/712, 660, 148/661, 662; 266/251

(56) References Cited

U.S. PATENT DOCUMENTS 5,452,882 A 9/1995 Joachim

FOREIGN PATENT DOCUMENTS

| | | | |
|---|---|---|---|
| DE | 296 03 022 U | | 4/1996 |
| EP | 0 182 050 A | | 5/1986 |
| EP | 0 803 583 A | | 10/1997 |
| EP | 0 911 418 A | | 4/1999 |
| JP | 51 133116 A | | 11/1976 |
| SU | 1049779 | * | 10/1983 |

* cited by examiner

*Primary Examiner*—Sikyin Ip

(74) *Attorney, Agent, or Firm*—Joshua L. Cohen; Salvatore P. Pace

(57) ABSTRACT

A method for quenching a heated metallic object includes discharging a plurality of discrete gas streams from a plurality of nozzle outlets so that the gas streams impinge substantially uniformly over the outer surface of the object, the distance between each nozzle outlet and the outer surface of the object against which the associated gas stream impinges is less than or equal to half the diameter of the nozzle outlet.

10 Claims, 7 Drawing Sheets

QUENCHING HEATED METALLIC OBJECTS

FIELD OF THE INVENTION

This invention relates to methods of quenching heated metallic objects.

BACKGROUND OF THE INVENTION

It is very well known that quenching a metallic object (i.e., rapidly chilling the object from a heat treatment temperature in the austenitic range to a much lower, usually room, temperature) can significantly improve its mechanical properties and characteristics. Quenching is used to harden the object and/or to improve its mechanical properties, by controlling internal crystallisation and/or precipitation, for example. Traditionally, quenching has been carried out using liquids such as water, oil or brine, either in the form of an immersion bath or a spraying system. In more recent years, gas quenching methods have been developed. Gas quenching has the advantages of being clean, non-toxic and leaving no residues to be removed after quenching, however difficulties have been encountered in achieving similarly high quenching rates as are provided by more conventional liquid quenching processes.

Quenching is a high speed process, requiring the heat within the object to be drawn away at a high heat flow density through the cooled surface of the object. It is usually desirable for the quenching of the object to be uniform, so that the quenched object has uniform surface or internal characteristics, however, uniformity of quenching is difficult to achieve in most quenching techniques, due to various factors, principally Leidenfrost's phenomenon. The quenching effect of any quench system is usually characterised in terms of the Grossman quench severity factor, H; for liquid quenchants such as water or oil, H usually falls in the range 0.2 to 4. Such high values of H are not easily attainable using gas quenching; when quenching using gas, the cooling intensity can be increased using several different means; increasing the quenching pressure; increasing the velocity at which the gas is sprayed on to the object; choice of gas (nitrogen is less preferable than helium, which is less preferable than hydrogen, because of their respective heat transfer coefficients, although helium and hydrogen are expensive compared to nitrogen); optimising the gas flow conditions and enhancing the turbulence, and enhancing the cooling of the gas.

Gas quenching employing multiple cooling gas streams comprising mainly nitrogen, argon and/or helium at pressures up to 60 bar has been practised in vacuum furnaces, and its characteristics for quenching bulk components are well known. More recently the gas quenching of single or small groups of components which had been heated in either vacuum or conventional atmosphere furnaces has been proposed. To eliminate the need to cool the furnace structure, these techniques involve the transfer of the object to be quenched to a specially designed cold chamber, as is known in the art.

In order to meet the criteria for uniform quenching of a single object or component it is necessary for the quenchant to reach the surface of the object uniformly. In practical gas quenching processes this implies that gas which has been heated through contact with the object must also leave the surface uniformly (so that further fresh, cold gas can reach the surface to continue the quenching process); therefore discrete amounts of arriving and departing gas must exist.

Theoretically these amounts would ideally be infinitely small, but practical considerations necessitate that they be as large as possible so far as is consistent with substantially uniform heat transfer.

A second factor affecting quenching uniformity is the interaction of the individual gas streams. It has been shown that, for constant mass flow and a stream width (d) to distance between the gas nozzle orifice and the surface of the object (a) ratio of four, the heat transfer coefficient reaches a maximum when the distance between adjacent gas streams (b) is three times the stream width (d). The turbulence formed at the edges of the gas streams as they impinge on the object surface is known to have a significant effect on the transfer of heat, however the form and size of these turbulent areas is difficult to predict due to the complex interaction between the gas streams.

A further factor affecting the uniformity of gas quenching is that although the velocity of the gas striking the object surface should be as high as possible, and as near perpendicular to the surface as possible, the velocity and angle of incidence relative to the surface of the gas streams must also be as uniform as possible, as the heat transfer coefficient is dependent on both of these. It has been suggested that, to maximise the heat transfer coefficient and to minimise the interaction factor between adjacent gas streams, the distance (a) between the gas nozzle orifice and the surface should be as large as possible so far as is consistent with the loss of velocity of the gas stream over distance. For example, U.S. Pat. No. 5,452,882 proposes that, in order to achieve a quench severity factor, H, of between 0.2 and 4, a plurality of gas streams of diameter d should be directed towards the object to be quenched from nozzles (of diameter d) spaced at a distance between 2 d and 8 d from the surface of the object and with a distance between adjacent nozzles, b, of between 4 d and 8 d. There is a continuing need to provide an efficient and economic gas quenching process capable of high quench severity and of substantial uniformity.

SUMMARY OF THE INVENTION

Accordingly, the present invention provides a method of quenching a heated metallic object comprising discharging a plurality of discrete gas streams from a plurality of nozzle outlets such that the gas streams impinge substantially uniformly over the outer surface of the object, wherein the distance (a) between each nozzle outlet and the outer surface of the object against which the associated gas stream impinges is less than or equal to half the diameter (d) of the nozzle outlets.

For the avoidance of doubt it should not be inferred from the use of the word "diameter" that the invention is limited to gas streams of circular cross section; the present invention extends to gas streams of any cross-sectional shape, the "diameter" of these being calculated through assuming that the cross-sectional area of a non-circular gas stream, for the purpose of putting this invention in to practice, is in fact circular. Thus the word "diameter" where used herein should be interpreted as meaning the diameter of a circular gas stream or the theoretical diameter of a circular gas stream which has an equal cross-sectional area to a non-circular stream. For such small distances between nozzle outlet and the object, the cross-sectional area and the "diameter" of the gas stream remains substantially constant throughout its transit between nozzle outlet and the object, and equal to the cross-sectional area and the "diameter" of the nozzle outlet.

The nozzle outlets may be of substantially equal cross-sectional area, or the area of the nozzles may vary, provided that the total area of nozzles per unit area of the object to be cooled remains substantially constant. It may, for example, be advantageous to have different nozzle areas in order to quench an object having a complex or convoluted surface shape or configuration.

We have discovered from investigating the complex interaction of the gas streams that there is an unexpected and surprisingly large and rapid increase in the heat transfer rate at very small values of the distance between the gas stream nozzle outlet and the surface of the object (ie where $a \leqq 0.5$ d), when the areas of high turbulence produced at the edges of the nozzles interact with the surface of the object to maximise the transfer of heat to the gas and to produce more uniform cooling. Also, as will be described further below, a method in accordance with the invention is demonstrably capable of providing a substantially uniform quench, as a varied quench, as desired.

The method of the invention also enables quench rates to be achieved which are equivalent to conventional oil quenching using nitrogen, without requiring a high pressure quenching environment as is often conventional practice. By mixing hydrogen in to the quenching gas stream quench rates equivalent to those of water quenching can be expected (hydrogen having roughly three times the cooling effect of nitrogen). Adding hydrogen would have a further advantage of keeping the component bright during the quenching process (but at a higher gas cost than nitrogen alone).

There are further practical advantages arising from the use of such small distances between the gas nozzle outlet and the object surface. As this distance (a) decreases, the pressure necessary to supply the gas streams at the required velocity will increase; to generate such pressures using conventional compressor apparatus (as suggested in U.S. Pat. No. 5,452,882, for example) is difficult and costly—both in capital and running costs—but if the gas streams were supplied from a compressed or liquid gas source there would be no need for compressor apparatus. Instead, the gas source would provide high pressure gas, the pressure of which could be easily and cheaply regulated down if necessary, so that there would be no compression cost (gases such as nitrogen routinely being supplied at high pressure, or in liquid form), the only cost therefore being that of the gas. Even the gas cost need not necessarily be totally lost, as the cold wall quenching chamber could be run at a small excess pressure over ambient, 10 kPa say, and the quenching gas reflected from the object used as the entire heat treatment protective atmosphere, or part thereof.

Preferably the distance (b) between adjacent nozzle outlets is less than or equal to eight times the diameter (d) of the nozzle outlets, and preferably more than two times this distance (d), so as to ensure uniformity of quenching.

The gas streams are preferably directed so as to impinge substantially perpendicularly on the surface of the object, to maximise quench severity.

Because the rate of cooling during quenching is directly related to the velocity of the gas streams, and the velocity to the gas supply pressure, it is a relatively simple matter to control the cooling rate. Those skilled in the art will appreciate the appropriate means whereby the gas supply pressure to the nozzle outlets can be controlled, thereby to achieve a very accurately controllable rate of cooling during the quenching process; it is patently possible to produce any instantaneous cooling rate, within the limit of the maximum cooling rate possible, so that austempering and marquenching of objects are easily achievable. Moreover, because the method of the invention is primarily intended for the quenching of single objects, it is possible to control with a high degree of accuracy the quenching rate with respect to the surface area of the object (so as, for example, to marquench one area of component whilst fast oil quenching another area in a single operation) and/or with respect to the quenching cycle (so as to vary the quenching rate during the quench), by controlling appropriately the quench gas flow rate, pressure and/or composition, and/or by varying the quench gas flow rate between different nozzles.

BRIEF DESCRIPTION OF THE INVENTION

The invention will now be described by way of example with reference to the accompanying drawings, in which.

DETAILED DESCRIPTION OF THE INVENTION

Figure 1:
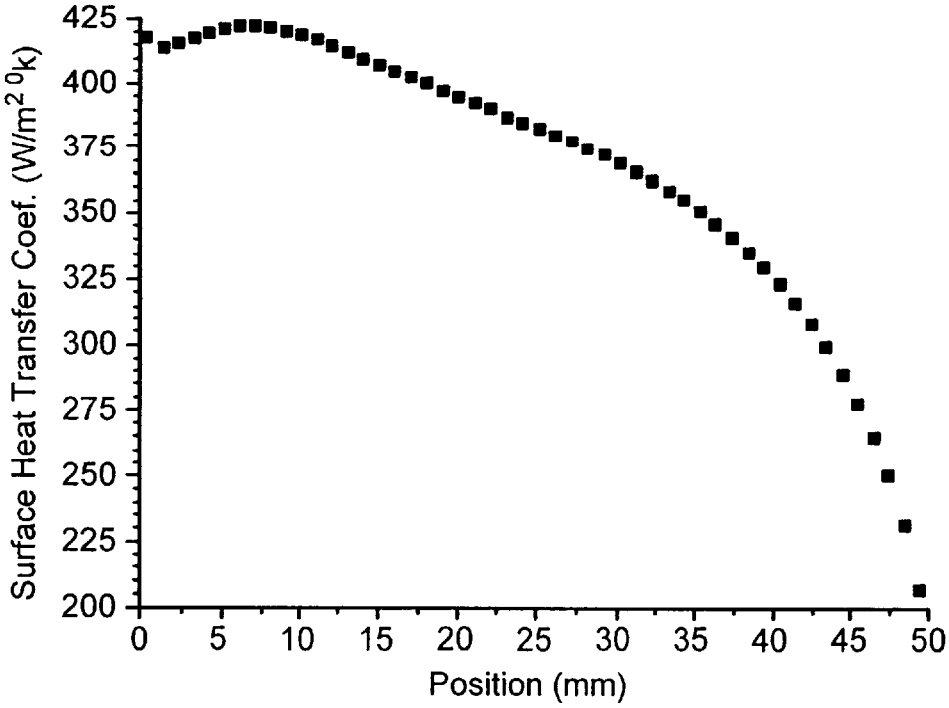
FIG. 1 illustrates the heat transfer coefficient of a gas stream impinging perpendicularly on a surface as a function of the distance from the centre line of the gas stream.

As can be seen from FIG. 1, the heat transfer coefficient for a nitrogen gas quenching stream is at a maximum directly below the outside edge of the nozzle, where the areas of high turbulence form, and falls off as the gas flow is deflected and becomes more parallel to the surface. In this example, gas velocity is 100 $ms^{-1}$, distance a between nozzle outlet and surface is about 50 mm and distance b between adjacent nozzles/streams is about 100 mm.

Figure 2A:
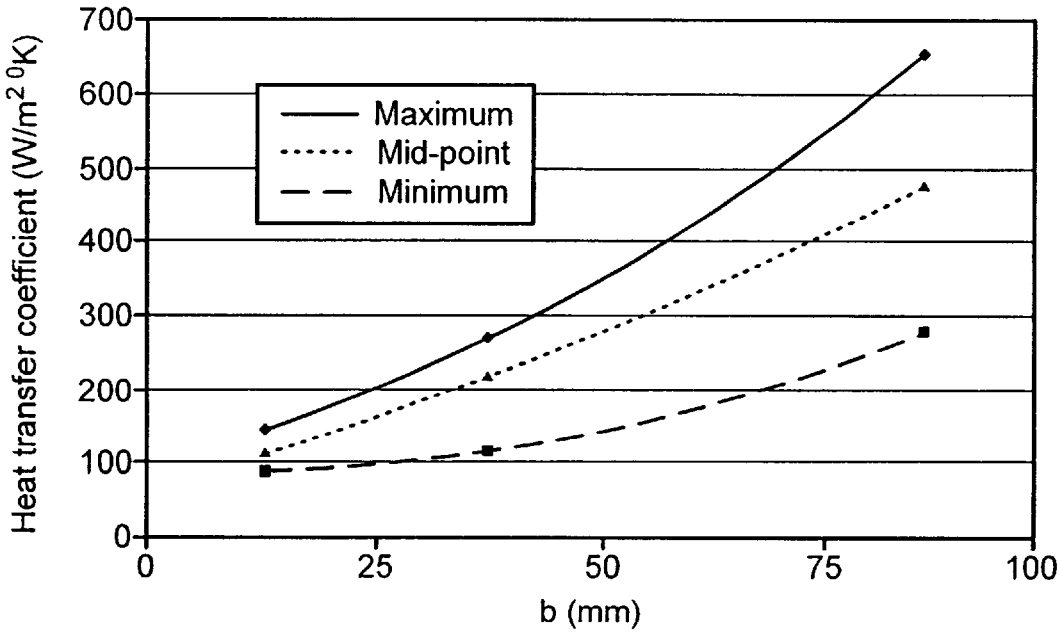
FIGS. 2A, 2B and 2C show the heat transfer coefficient in a nitrogen gas quench system as a function of the distance (b) between adjacent gas streams at three different distances (a) between the gas nozzle outlet and the surface to be cooled/quenched.
Figure 2B:
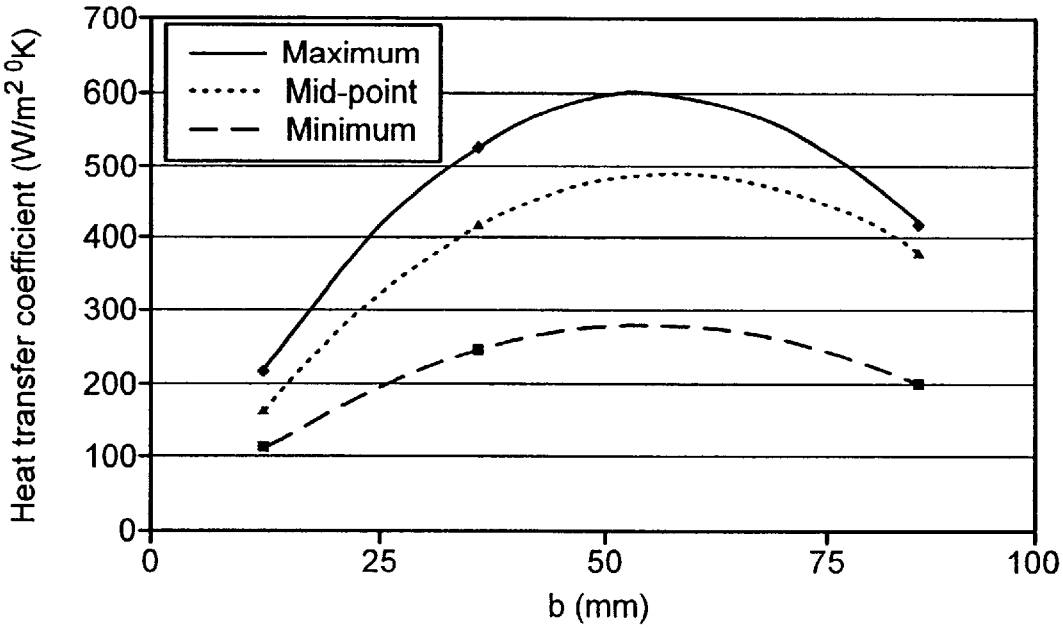
Figure 2C:
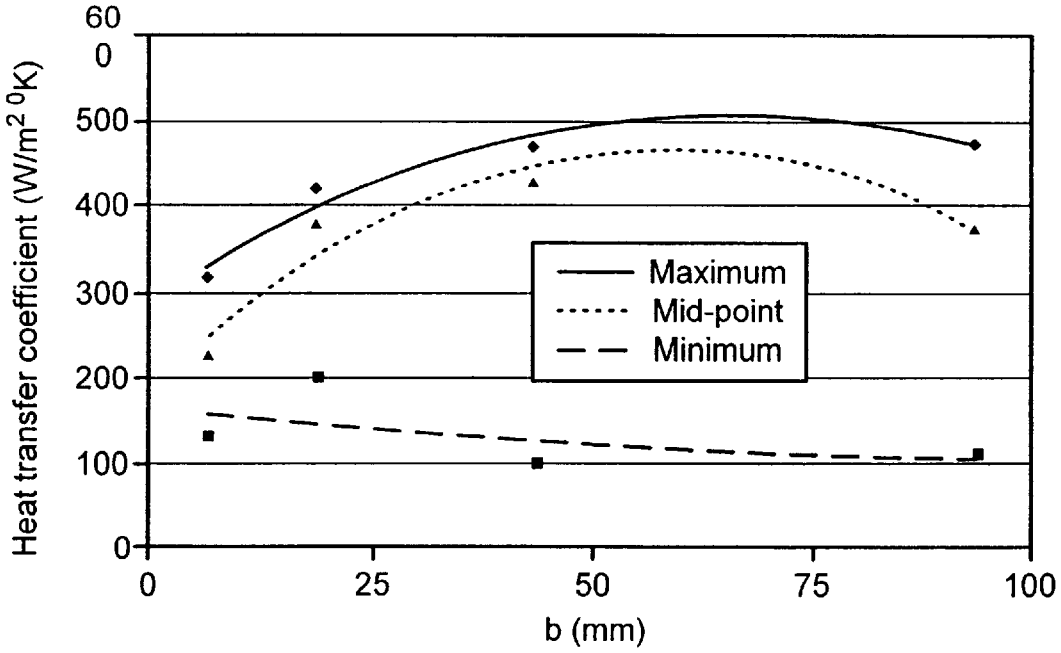

FIGS. 2A to 2C show the heat transfer coefficient as a function of the distance b between adjacent nozzles for a gas velocity of 100 $ms^{-1}$ and at a distance a between nozzle outlet and surface of 100 mm (FIG. 2A), 51 mm (FIG. 2B) and 25 mm (FIG. 2*c*). On each graph (and in FIGS. 3A to 3D) three curves are plotted, corresponding to the maximum, minimum and mid point heat transfer coefficients; with reference to FIG. 1 the maximum heat transfer coefficient corresponds to the peak in the curve, at the point where the areas of high turbulence form in the gas stream, the minimum heat transfer coefficient occurs at the mid point between adjacent gas streams (ie in FIG. 1, about 50 mm away from the centre line of the gas stream), and the mid point heat transfer coefficient is the coefficient midway between the centre line of the gas streams/nozzles and the line midway between the jets (ie in FIG. 1, 25 mm from the nozzle centre line). As can be seen, there is a pronounced maximum heat transfer coefficient and an increased uniformity therein (ie there are corresponding maxima in the maximum, minimum and mid pint heat transfer coefficients) as the distance a between gas nozzle outlet and surface decreases.

Figure 3A:
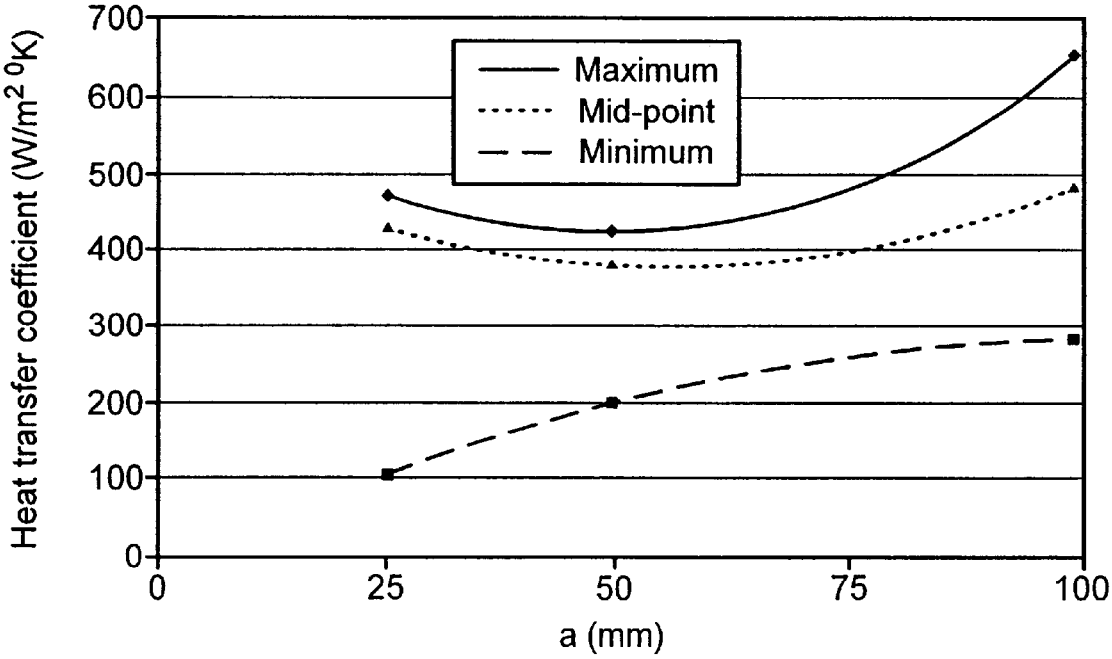
FIGS. 3A, 3B, 3C and 3D illustrate the variation of the heat transfer coefficient in a nitrogen gas quench system as a function of the distance (a) between the gas nozzle outlets at different distances (b) between adjacent streams/nozzles.
Figure 3B:
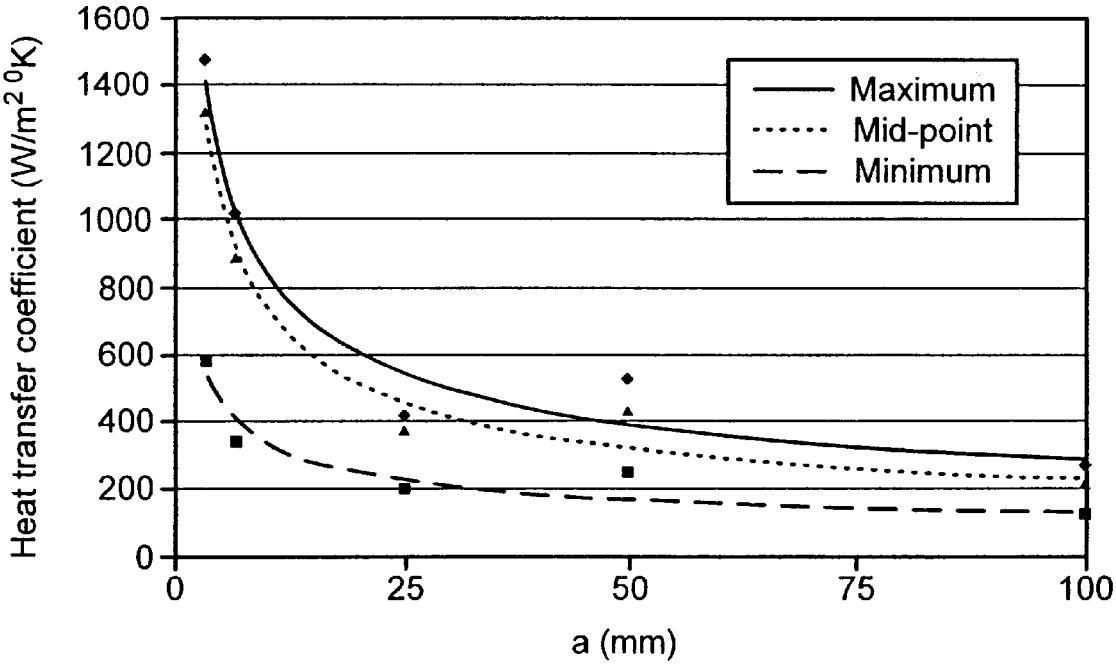
Figure 3C:
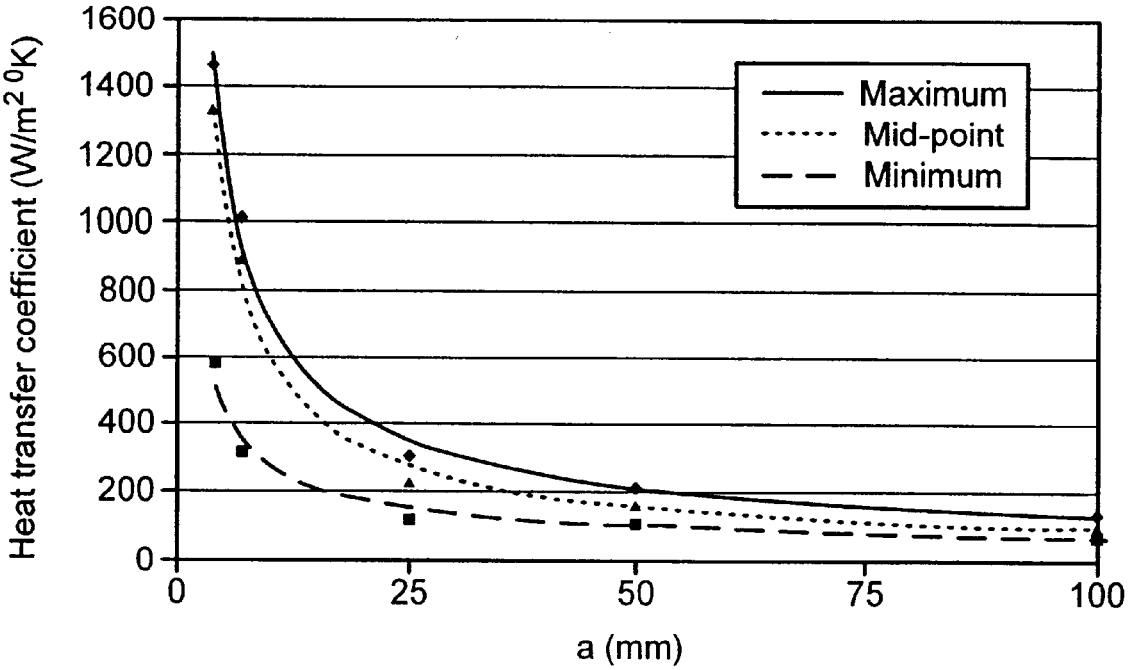
Figure 3D:
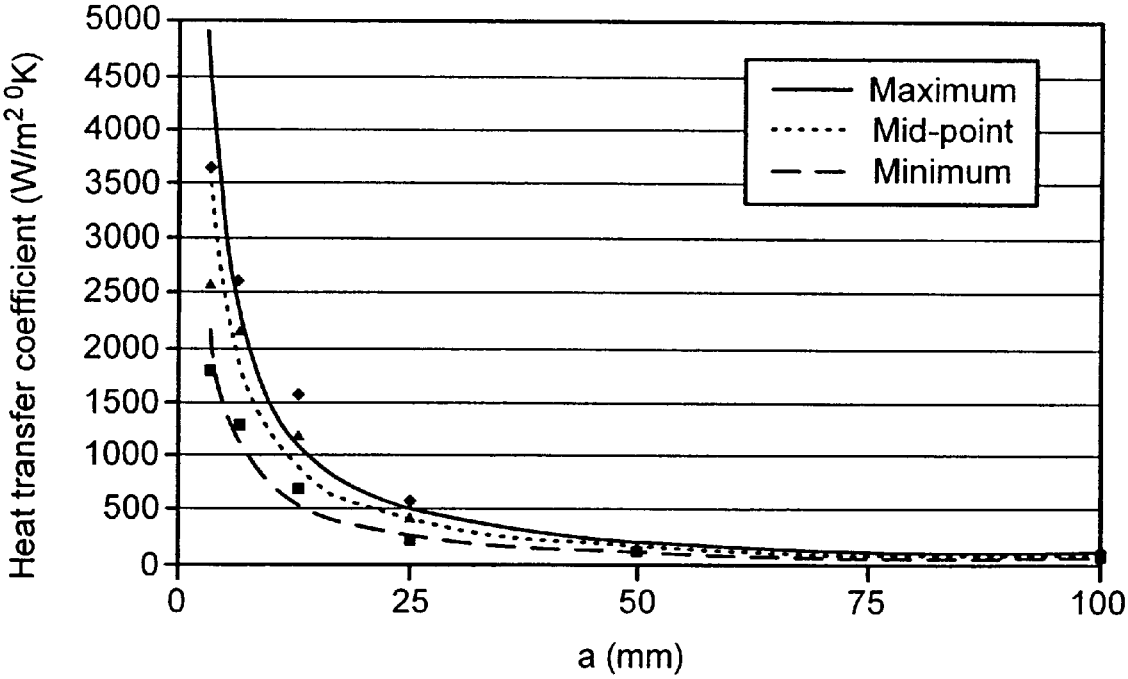

In FIGS. 3A to 3C, where the gas velocity is 100 $ms^{-1}$ and the distance b between adjacent nozzles is 89 mm (FIG. 3*a*), 38 mm (FIG. 3*b*) and 13 mm (FIG. 3*c*), it can be seen that there is a significant increase in the heat transfer coefficient at small values of distance b as the value of a, the distance between gas nozzle outlet and the surface, decreases below the value of b. A similar effect is achieved at higher and lower gas velocities, as is illustrated by FIG. 3D which shows the heat transfer coefficient at a gas velocity of 300 $ms^{-1}$ and a distance b between gas streams of 13 mm.

From the data illustrated in FIGS. 2 and 3 it is apparent that the heat transfer coefficient is inversely proportional to the distance a between the nozzle outlets and the surface. While the distance between nozzles has an increasing effect at larger values of a, its effect at small values of a appears minimal up to at least two times the nozzle/gas stream diameter d. Whilst it may have been reported that maximum heat transfer rates occur where a is equal to or greater than 8 d and b is equal to or greater than 8 d, the rapid increases in heat transfer rate at very small separations (where a is less than or equal to d, and b is less than 3 d) has not previously been noted. The high maximum heat transfer rate in this region is also associated with high mid-point and minimum heat transfer rates, which is important for achieving uniformity of quenching. Indeed, the increase in heat transfer rate is particularly marked at values of a less than 0.5 d, d being equal to 12.7 mm.

Figure 4:
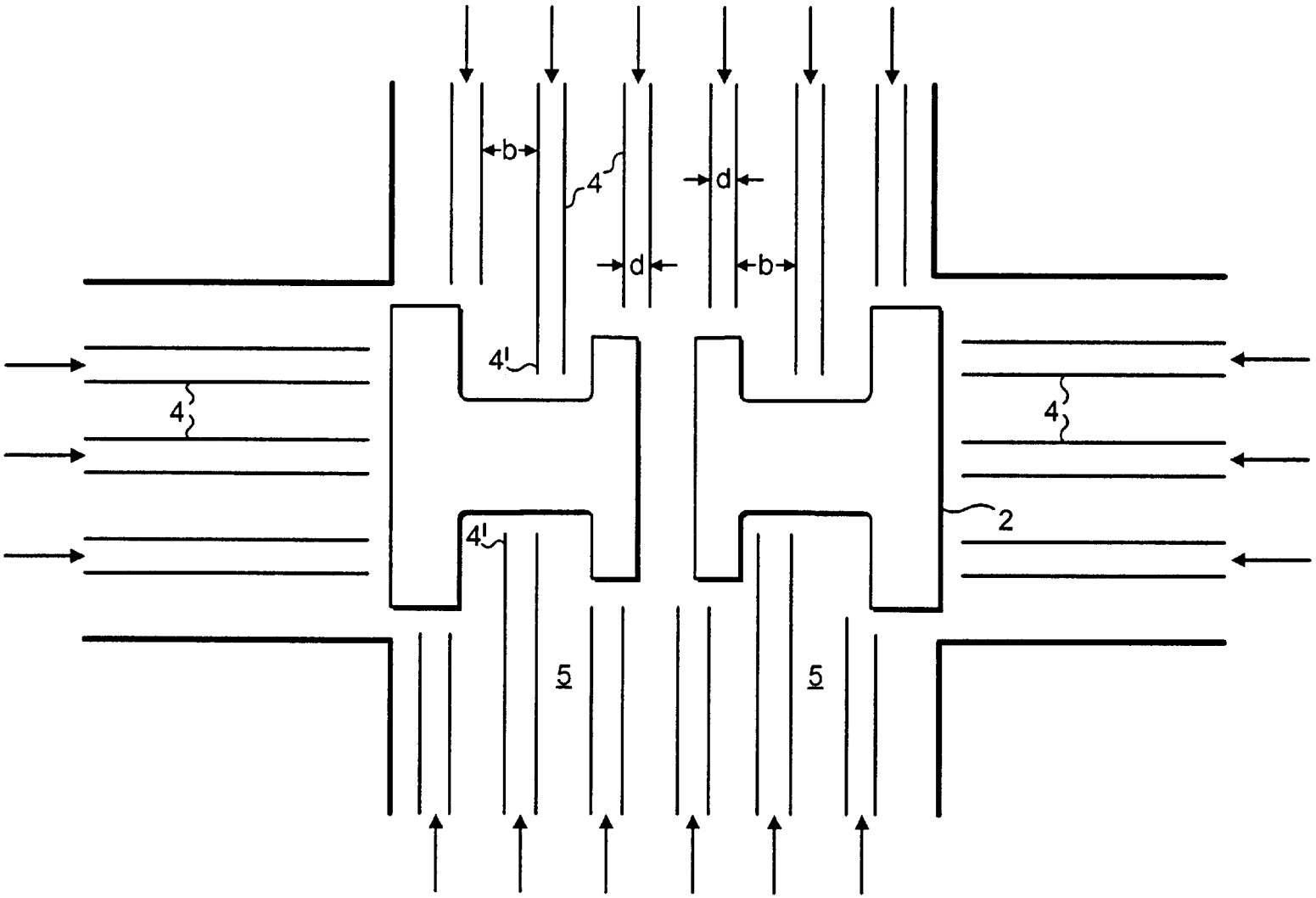
FIG. 4 is a schematic cross-sectional view of an arrangement for quenching a heated gear wheel.

FIG. 4 shows a gear wheel 2 centred within an array of nozzles 4, each nozzle being arranged to direct a gas stream, which travels in the direction of the arrows in the Figure, so as to impinge perpendicularly on to the gear wheel 2. The nozzles 4 have a uniform diameter d and the distance b between adjacent nozzles is twice d. The ends 4' of the nozzles are a distance a away from the closest surface of the gear wheel 2, and a is approximately equal to b. The arrows indicate the flow of gas in to the nozzles, gas which has already impinged on the surface of the gear wheel 2 being reflected away therefrom and drawn away along the interstices 5 between nozzles. As will be readily understood, individual nozzles 4 are preferably reciprocable along their longitudinal axis so as to adjust distance a to any desired value and/or to accommodate an object for quenching of any configuration. Accurate control of the quenching process is easily achieved by controlling the pressure of the gas supplied to the nozzles 4, and hence the velocity of the gas streams.

Figure 5:
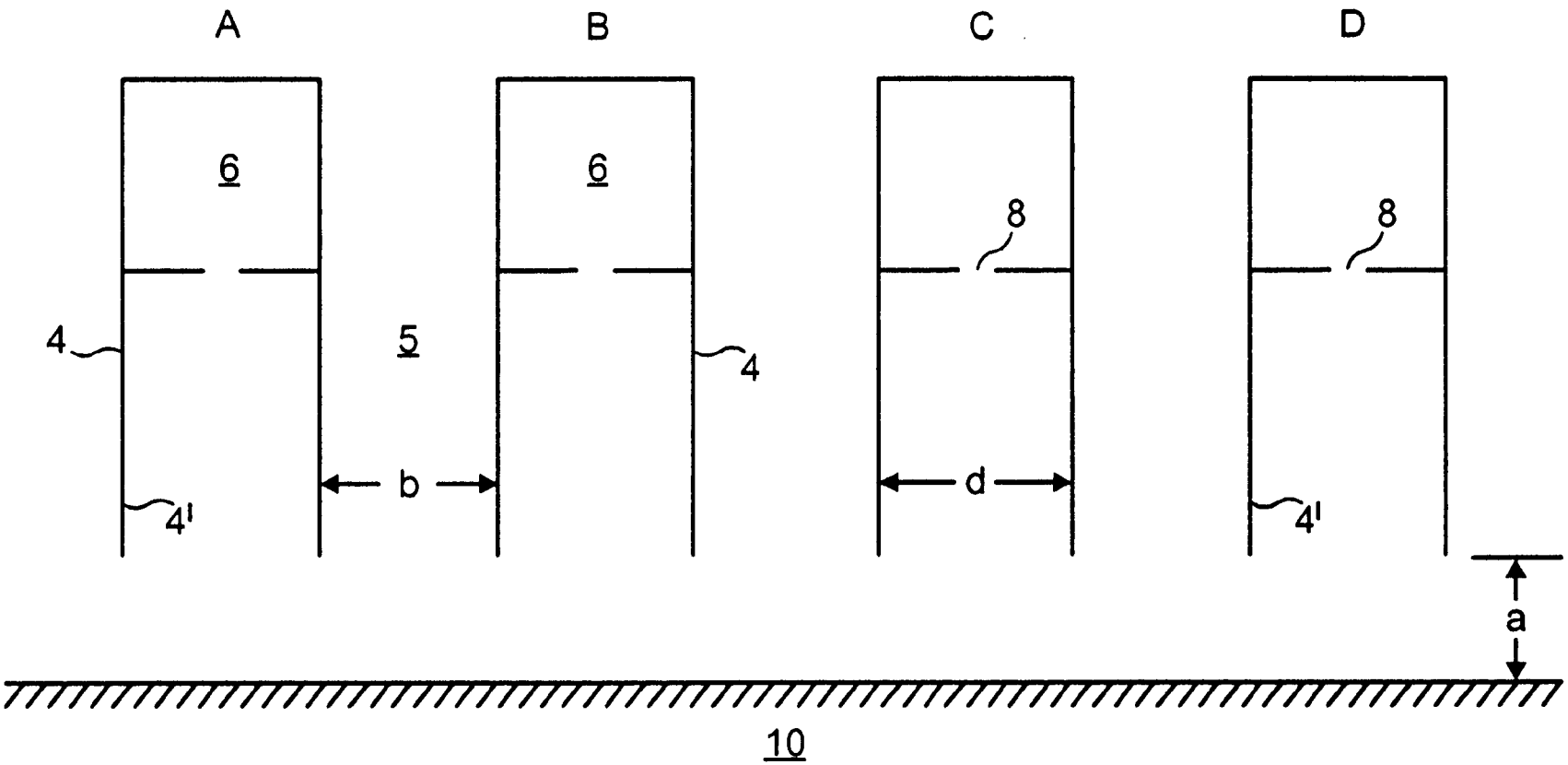
FIG. 5 is a schematic end view of part of a nozzle array for carrying out gas quenching in accordance with the invention.
Figure 6:
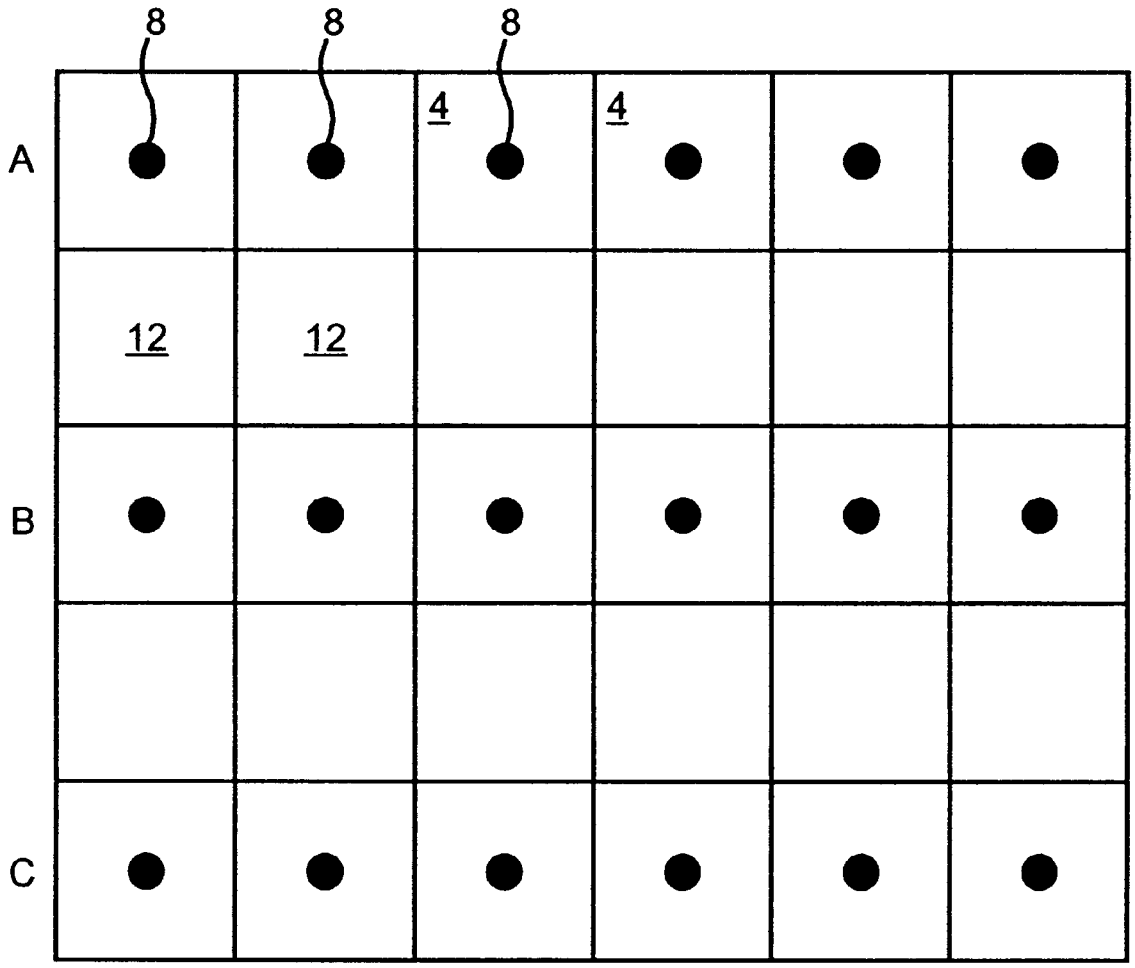
FIG. 6 is a schematic plan view of the nozzle array of FIG. 5.

FIGS. 5 and 6 are end elevation and plan views, respectively, of part of the array of nozzles 4 of FIG. 4 illustrating rows A, B, C, D of nozzles 4 each of which nozzles comprises a plenum chamber 6 having a hole 8 for passage of gas under pressure from the plenum chamber 6 in to the nozzle and out through the nozzle outlet 4' towards the surface 10 to be quenched. The nozzles are rectangular in cross-section, and similarly rectangular outlet passages 12 are provided between the rows of nozzles 4 (ie in the interstices 5 between adjacent nozzles) for withdrawing gas away from the surface 10 after the gas has quenched the surface. The area of the holes 8 should be less than the cross-section of the plenum and the gas pressure in the plenum chamber 6 will exceed the pressure in the nozzles 4 by a factor approximately equal to the ratio of the area of the hole 8 to the area of the nozzle 4. A gas pressure of approximately 60 kPa would suffice to provide a gas velocity of 100 $ms^{-1}$, and approximately 500 kPa to provide a velocity of 300 $ms^{-1}$. The limiting gas velocity would be the speed of sound, about 340 $ms^{-1}$.

A further advantage of the system of this invention arises from the typically high gas pressures. As a result of the high pressures used it should be possible to eliminate the need for a product support during quenching. The effect of the product's weight will be small compared to the applied force of the gas and the product would float within the nozzle field. Small inconsistencies would be introduced in to the flow field in a practical device and would lead to oscillation or rotation of the component producing more even quenching. If the ratio of the nozzle diameter to the distance between the nozzle and the surface is chosen as four (the point at which the area for gas escape equals the area of the nozzle) then any reduction in distance between the nozzle and the surface caused by the object moving will lead to an increase in pressure at the nozzle outlet, which will urge the surface away from the nozzle, so that the vibrations of the component within a nozzle array will tend to be self compensating. The high velocities used will lead to high noise levels in the vicinity of the quench. However, it should be possible to minimise this effect by proper use of sound insulation around the cold wall quenching chamber.

As an example a typical automotive gear having 150 mm diameter with a 20 mm face and a 20 mm bore is cooled in the apparatus of FIGS. 4 and 5. The total area to be quenched is approximately 0.045 $m^2$, and the total mass of the year is approximately 1.35 kg. Assuming a nozzle configuration where the gap between nozzles is three times the nozzle diameter and a gas velocity of 100 m/s is required to achieve H=0.8 then the cooling time is approximately 30 secs. The volume of gas required to quench the year is 3.9 $m^3$. The pressure required to create the required velocity at the nozzle tip is approximately 200 kPa (1 barg) thus the force being applied to side of the gear is 5.3 kg which is well in excess of the weight of the gear. For a practical quenching system, the pressure necessary in the system to produce such a nozzle tip pressure would be less than 600 kPa (5 barg).

In order to minimise costs it is necessary to minimise the overall flow of quenching gas. As the gas flow for a given nozzle is fixed by the cooling rate required, the only available variable is the distance b between nozzles. Surprisingly, it has been found that varying the distance has little effect on the heat transfer coefficient, which shows an almost linear, and relatively slow, decline as b is varied between two and eight times the nozzle diameter. This effect is due to the area of high turbulence created at the edge of the nozzles at high gas velocities.

The heat transfer coefficient is also relatively insensitive to scale, such that if all the sizes of a quenching system in accordance with the system are reduced by a factor of four (which is likely to include the maximum practical range of gas jet sizes) there is an increase in heat transfer coefficient of only about 30%

This lack of sensitivity to the size of the nozzles and the distance between them makes the design of quenching enclosures, especially for complex shapes, much simpler. However the close approach to the surface required does result in the need for careful consideration of the nozzle sites. As a result of the high pressures used it should, as described above, be possible to eliminate the need for a product support during quenching. The effect of the product's weight will be small compared to the applied force of the gas and the product would float within the nozzle field.

Because the cooling rate is almost linearly related to the gas velocity at gas velocities below 100 m/s, and the velocity is related to the supply pressure, it is obviously simple to control the cooling rate. Although higher velocities towards sonic will result in higher cooling rates the rate of increase is non-linear and the use of higher velocity is likely to be restricted to applications where the highest possible cooling rates are required. Not only is it possible to achieve a controllable rate but that rate can be varied through the quench cycle to produce any cooling profile within the limits of the maximum rate available. Thus austempering, marquenching and delayed quenching are easy to achieve. The effect of doubling or halving each of the parameters increasing the mean heat transfer coefficient is summarised in the following table:

| Parameter | Double/ Half | Range | % Increase in mean heat transfer coefficient |
|---|---|---|---|
| Gas Velocity | Double | 50–100 m/s | 50 |
| Distance between nozzle and surface (a) | Half | 6.4–3.2 mm | 37 |
| Distance between nozzles (b) | Half | 50.8–101.6 mm | 14 |
| Nozzle diameter | Half | 12.7–6.4 mm | 15 |

It is notable that reducing the distance a from approximately 0.5 to approximately 0.25 d caused a 37% increase in the mean heat transfer coefficient (d=12.7 mm).

While uniform quenching is often the aim, this system of individual component gas quenching opens the door to deliberate and controllable non-uniform quenching. For example in gear heat treatment it is possible to quench only the face and bore of a gear while producing a tough pearlitic web. It is also possible to quench only the wear faces of a shaft and not the threaded portion saving on costly stopping-off during the carburising treatment. Obviously very dependant upon the component, stopping-off typically accounts for 15 to 30% of the cost of the heat treatment.

In summary, gas quenching of individual components using nitrogen alone in a non-pressurised environment can achieve oil-like quenching characteristics. In order to achieve these rates the gas delivery nozzles must be at a distance from the component that is less than the diameter of the nozzle. The distance between the nozzles in the nozzle field has little effect on the maximum or minimum rate achieved within the nozzle field as long as it is less than eight nozzle diameters.

I claim:

1. A method of quenching a heated metallic object comprising:

discharging a plurality of discrete gas streams from a plurality of nozzle outlets; and impinging the plurality of discrete gas streams substantially uniformly over an outer surface of the object, wherein a distance (a) between each nozzle outlet and the outer surface of the object against which the gas streams impinge does not exceed a value equal to half a diameter (d) of each of the nozzle outlets.

2. The method of claim 1, wherein the distance (a) is m the range 0.25 to 0.5 of the diameter (d).

3. The method of claim 1, wherein a distance (b) between adjacent nozzle outlets does not exceed a value equal to eight times the diameter (d) of each of the nozzle outlets.

4. The method of claim 1, wherein the distance (b) between adjacent nozzle outlets is at least equal to twice the diameter (d) of each of the nozzle outlets.

5. The method of claim 1, wherein the plurality of discrete gas streams impinge substantially perpendicularly to the outer surface of the object.

6. The method of claim 1, further comprising:

varying a pressure of gas supplied to the plurality of nozzle outlets to vary the velocity of the plurality of discrete gas streams and the rate of cooling of the object.

7. The method of claim 1, wherein the plurality of discrete gas streams comprises elements selected from the group consisting of nitrogen, helium, hydrogen and a mixture thereof.

8. The method of claim 7, further comprising supplying a reservoir of gas for the step of discharging a plurality of discrete gas streams.

9. The method of claim 1, further comprising collecting gas reflected from the outer surface of the object, and directing the gas to surround the object to exclude ambient air from contact with the object during quenching.

10. The method of claim 8, wherein the gas is selected from the group consisting of compressed gas and liquid gas.

* * * * *